US006659321B2

(12) United States Patent
Hartranft et al.

(10) Patent No.: US 6,659,321 B2
(45) Date of Patent: Dec. 9, 2003

(54) POCKET-MOUNTED TOOL POUCH

(75) Inventors: Bruce W. Hartranft, St. Charles, IL (US); John Zachary, Phoenix, AZ (US); David A. Trotter, Oshawa (CA)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 09/791,909

(22) Filed: Feb. 22, 2001

(65) Prior Publication Data

US 2002/0113107 A1 Aug. 22, 2002

(51) Int. Cl.[7] ..... A45C 11/00

(52) U.S. Cl. ..... 224/683; 224/182; 224/677; 224/230

(58) Field of Search ..... 224/581, 582, 224/587, 197, 182, 609, 677, 681, 682, 683, 684, 230, 223, 904, 671, 673, 666, 239, 240, 678

(56) References Cited

U.S. PATENT DOCUMENTS 551,359 A * 12/1895 Braillard ..... 224/660
2,558,382 A * 6/1951 Previdi ..... 2/250
2,850,152 A * 9/1958 Marrufo ..... 206/234
2,983,412 A * 5/1961 Ferguson ..... 224/683
3,295,235 A * 1/1967 Tauber ..... 224/230
3,371,829 A * 3/1968 Phillips ..... 2/250
3,797,717 A * 3/1974 Collins ..... 224/230
4,310,109 A * 1/1982 Coyle ..... 206/37
4,325,469 A * 4/1982 Gurian ..... 156/250
4,372,468 A * 2/1983 Harvey ..... 224/904
D271,253 S * 11/1983 Abatie ..... 224/673
4,570,688 A * 2/1986 Williams ..... 150/102
4,705,086 A * 11/1987 O'Neill ..... 150/134

* cited by examiner

*Primary Examiner*—Nathan J. Newhouse
(74) *Attorney, Agent, or Firm*—Cook, Alex, McFarron, Manzo, Cummings & Mehler, Ltd.

(57) ABSTRACT

A tool pouch includes an internal tool receiving portion and an external tool receiving portion such that the internal tool receiving portion is insertable into the user pocket to provide a protective tool holder within the user pocket and the external tool receiving portion is positioned outside of the user pocket for receiving tools. The internal tool receiving portion has first and second internal members which are generally planar elements that are attached to each other to form an internal tool receiving cavity. The external tool receiving portion has first and second external members which are generally planar elements that are attached to each other to form a second tool receiving cavity. The internal and external tool receiving portions are connected at a bail. Any part of the internal or external tool receiving portions may be substantially formed from a multi-layered piece of material. An underlying stiffening element may be used to strengthen any portion of the tool pouch. Reinforcing tape is stitched along the sides and ends. A belt loop or slots may be added on a surface adjacent the user.

19 Claims, 2 Drawing Sheets

POCKET-MOUNTED TOOL POUCH

BACKGROUND OF THE INVENTION

The present invention relates to a tool pouch which inserts into a pocket of the user and integrates an inside pocket holder with an outside pocket tool holder to provide tool receiving cavities located both internally and externally to the user pocket. Electricians and other workmen frequently find themselves carrying tools in their pockets. This is especially true if they are only carrying a few tools because it is easier to put these few tools in their pockets than rigging a tool pouch. Oftentimes, the tools can be quite sharp, as with the case of some electrical tools, and tend to pierce the fabric of workmen's pants or other pieces of clothing. Workmen are occasionally injured when the sharp tools dig into their skin through the thin fabric of their clothing during routine working activities. The pockets will develop holes or tears from frequent use. It further can be difficult to remove tools from pockets, particularly pant pockets, due to the coarseness of the fabric or the tightness of the clothing on the user.

Current inside-the-pocket tool holders provide protection to the user's pant pocket but only provide for the placement of tools within the pant pocket. There may not be enough room in the pant pocket to accommodate the worker's tools making it important to provide the worker with a pocket-mounted holder which can accommodate more tools outside of the pocket.

Other tool pouches provide tool-receiving compartments which are positioned outside of the pocket and are mounted to the pant pocket with hooks or insertion tabs. These outside-of-the-pocket tool pouches do not have tool-receiving compartments located internally of the user pant pocket. Users are left with nothing to protect their pant pocket if they need to place additional tools in their pocket. Thus, there is a desire for a tool pouch which combines the features of an inside-the-pocket tool holder with those of an outside-the-pocket tool holder.

SUMMARY OF THE INVENTION

The present invention provides a pocket-mounted tool pouch with tool receiving compartments which receive tools both inside the user pocket and outside the user pocket.

A primary purpose of the invention is to provide a tool pouch having an internal tool receiving portion and an external tool receiving portion for receiving tools both inside and outside of the pocket.

Another purpose of the invention is to provide a tool pouch made of a protective material to protect the user from injury due to the placement of sharp tools in the tool pouch compartments.

Another purpose of the invention is to provide a tool pouch having a smooth surface in order to facilitate insertion and extraction of tools from the pouch.

Still another purpose of the invention is to provide a tool pouch which protects the pocket from excessive wear due to frequent insertion and extraction of tools from the pockets.

Yet another purpose of the invention is to provide a tool pouch which protects the pocket from dirt, oil and the like which can be frequently deposited on tools.

A further purpose of the invention is to provide a tool pouch which doubles the tool carrying capacity of the pocket while providing a sleek, professional and organized appearance for the user.

An additional purpose of the invention is to provide a tool pouch which allows for removal of all tools at once merely by lifting the tool pouch out of the pocket.

Another purpose of the invention is to provide a tool pouch which can be either mounted to a pocket or attached to a belt depending on the day-to-day needs of the user.

Other purposes will appear in the ensuing specification, drawings and claims.

DETAILED DESCRIPTION OF THE INVENTION

The tool pouch 10 includes an internal tool receiving portion 12 and an external tool receiving portion 14. The internal tool receiving portion 12 is insertable into the user pocket 13 to provide a protective tool holder within the user pocket. The external tool receiving portion 14 is positioned outside of the user pocket 13 for receiving tools. Although the internal and external receiving portions will be shown and described as substantially being made from a single piece of material which is folded over onto itself, it is possible that they can be constructed from separate pieces which are sewn, glued or otherwise fastened together. Whereas the drawings show a double fabric layer being attributed to the tool pouch parts, a single fabric layer could be used. Moreover, while the invention is shown and described as being insertable into a user pant pocket, it is applicable to any clothing pocket.

Figure 1:
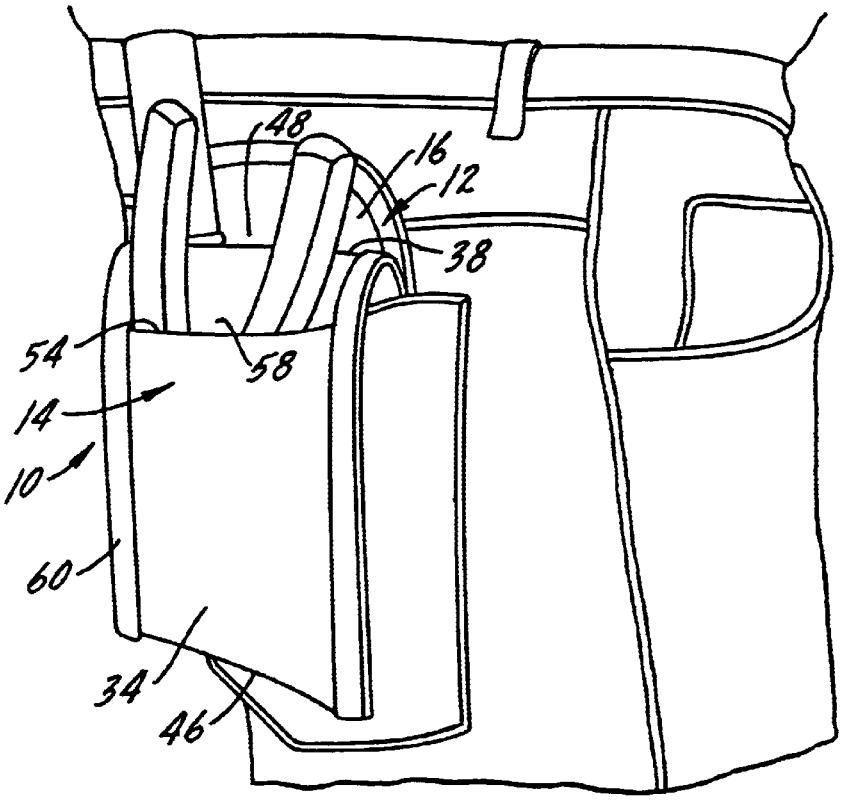
FIG. 1 is a perspective view of one embodiment of the tool pouch of the present invention shown as being mounted to a user pant pocket.
Figure 2:
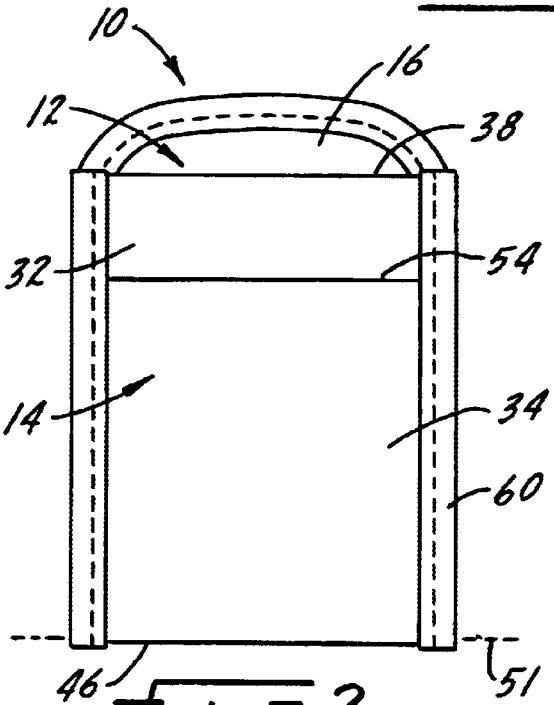
FIG. 2 is a front elevation view of the tool pouch.

In FIGS. 1 through 8, the internal tool receiving portion 12 is made of a first internal member 16 and a second internal member 17. The first internal member 16 is generally planar and has side edges 18, a top end 20, a bottom end 22, and a user contact surface 24 which is positioned closest to the user when the first internal member is positioned within the user pocket. The side edges 18 and ends 20, 22 are sized to be substantially received by the user pocket. As shown in FIG. 1, it is preferred that the first internal member 16 be sized as large as possible while still fitting within the user's pocket 13. The first internal member top end 20 preferably extends upward from the top of the user's pocket when the tool pouch is positioned therein. Other shapes and sizes are also possible so long as the tool pouch is capable of being received by the pocket in the user's clothing.

The first internal member 16 is shown as being constructed with an underlying or internal stiffening element 28 (shown in dotted lines in FIGS. 3 through 5) with an overlying resilient material. This construction provides the desired degree of rigidity and resiliency. Specifically, the tool pouch will tend to keep its shape regardless of what tools are placed within it.

Figure 4:
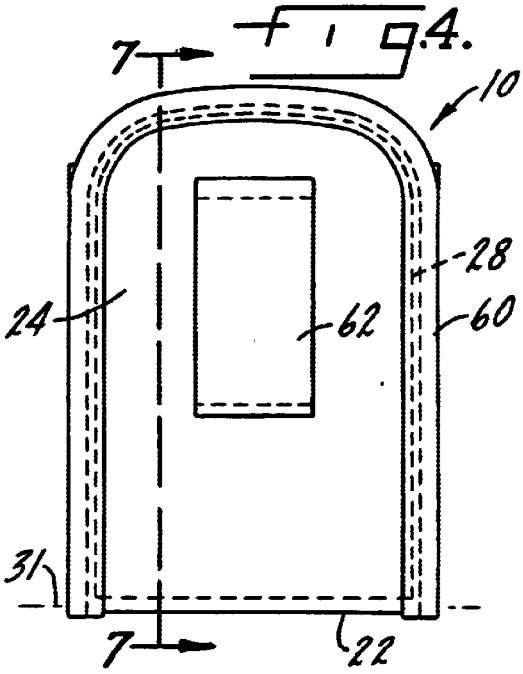
FIG. 4 is a rear elevation view of the tool pouch shown with a belt loop.
Figure 5:
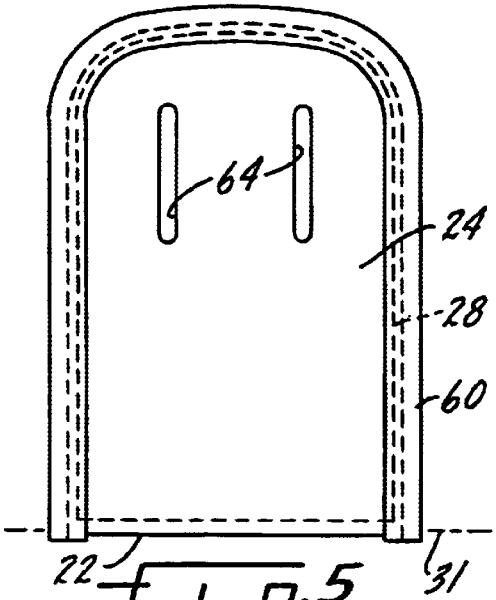
FIG. 5 is a rear elevation view of the tool pouch shown with alternate belt slots.
Figure 6:
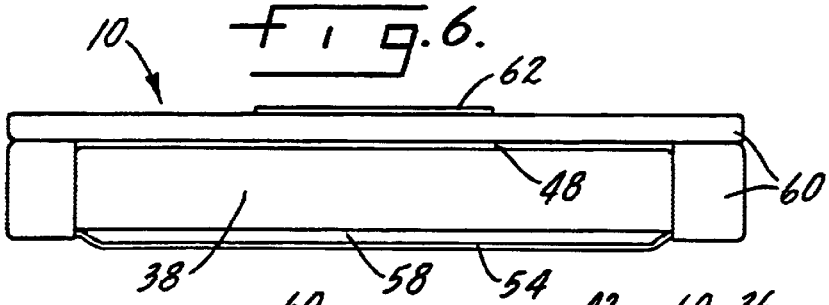
FIG. 6 is a plan view of the tool pouch, on an enlarged scale.

FIGS. 3 through 8 show a first fold line 31 which separates the first internal member 16 from the second internal member 17 with the bottom end 22 common to both the internal members 16, 17. The second internal member 17 has a generally planar shape and includes side edges 36, a top end 38 and the bottom end 22. Although the second internal member 17 may have any dimensions, it is preferred that it be sized substantially the same as the first internal member, i.e., as large as possible while still being received by the user pocket. The second internal member side edges 36 are attached to the first internal member side edges 18 opposite the user contact surface 24 with both top ends 20, 38 left open as shown in FIG. 6. As such, the first internal member 16 and the second internal member 17 can be described as the elements which define an internal tool receiving cavity 48 therebetween.

Similarly, the external tool receiving portion 14 has a first external member 32 and a second external member 34. The first external member 32 of the external tool receiving portion 14 is connected to the second internal member 17 of the internal tool receiving portion 12 on the side opposite the first internal member 16. The connection between the internal and external tool receiving portions 12, 14 occurs at the top end 38 and forms a bail 50. Although the external tool receiving portion 14 is shown to have substantially similar dimensions as the internal tool receiving portion 12, it is possible for the external tool receiving portion to have different dimensions and a different shape than the internal tool receiving portion.

Figure 8:
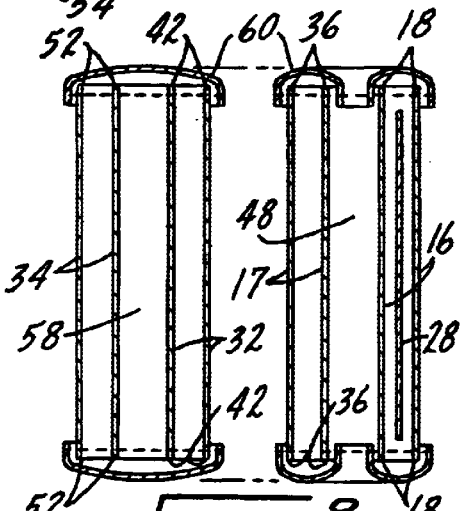
FIG. 8 is a section taken along line 8—8 of FIG. 7.

Both the first and second external members 32, 34 are generally planar. The first external member 32 has side edges 42, a bottom end 46, and shares the top end 38 at the bail 50 with the second internal member 17. The second external member 34 has side edges 52 and a top end 54 and shares the bottom end 46 with the first external member 32 along a fold line 51. The second external member 34 is attached to the first external member on the side thereof opposite the second internal member 17 along side edges 42, 52 as best seen in FIG. 8. The top end 54 is left open. As such, the first and second external members 32, 34 can be described as the elements which define an external tool receiving cavity 58. Although any size or shape is possible for the second external member 34, it is preferred that its sides 52 be aligned with the side dimensions of the first external member 32. The second external member top end 54 may be located slightly below the first external member top end 38 or the bail 50 to facilitate the insertion of tools into the external tool receiving cavity 58 by the user. Other orientations of the second external member top end are possible such as where the top end is located higher than the first external member top end 38 to accommodate larger tools or prevent tools from falling out.

Either of the tool receiving cavities 48, 58 may be divided into compartments to hold tools individually or prevent tools from becoming tangled. Additional cavities, receptacles, loops or the like may be attached to the second external member to hold additional tools outside of the user's pocket.

Figure 3:
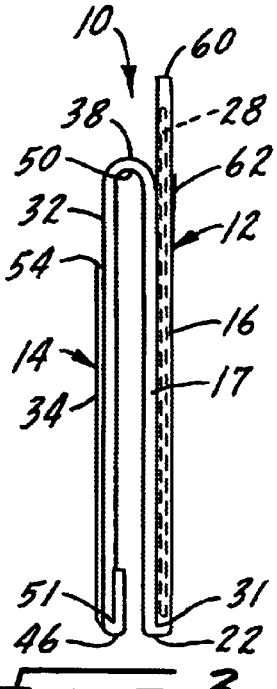
FIG. 3 is a side elevation view of the tool pouch.

FIGS. 3 through 8 illustrate the tool pouch with a belt attachment. In FIGS. 3, 4, and 6, a belt loop 62 is attached to the user contact surface 24 of the first internal member 16. In FIG. 5, slots 64 are shown as an alternate method for insertion of a belt within the user contact surface 24 of the first internal member 16. Although the belt loops and slots are shown as being positioned on the first internal member, other placements are also possible.

The tool pouch is preferably made from a resilient protective material such as nylon or the like to protect the user from injury from the placement of sharp tools in the tool pouch pockets. The tool pouch has a multi-layered construction where at least a two-layer fabric thickness is used. The additional layers of material may be an overlapped portion of a single piece of fabric as shown, or separate pieces of fabric, either comprised of the same or similar material or different kinds of material. The additional thickness of a multi-layered construction provides added strength, rigidity and durability to the tool pouch and prevents injury to the user by sharp tools within the tool pouch. It is important that the overlying protective material has a relatively smooth surface in order to facilitate insertion and extraction of tools from the user's pocket and to prevent tools from snagging on the surface. Durability and wear characteristics of the pouch are also important. The pockets and edges must withstand abrasion and wear from frequent use and resist puncture from tools placed within the pouch. The pouch preferably is made of at least two layers of an overlapped or folded over piece of uncut fabric. Alternatively, a single layer of 600-denier fabric having double thickness may also be used to construct the pockets or other parts of the pouch.

In FIGS. 1 through 8 reinforcing tape 60 is added along the attached member sides edges of both the internal and external tool receiving portions 12, 14 in order to increase the strength and durability of the tool pouch. The tape is preferably cloth material that is sewn or stitched to the side edges of the various layers.

Figure 7:
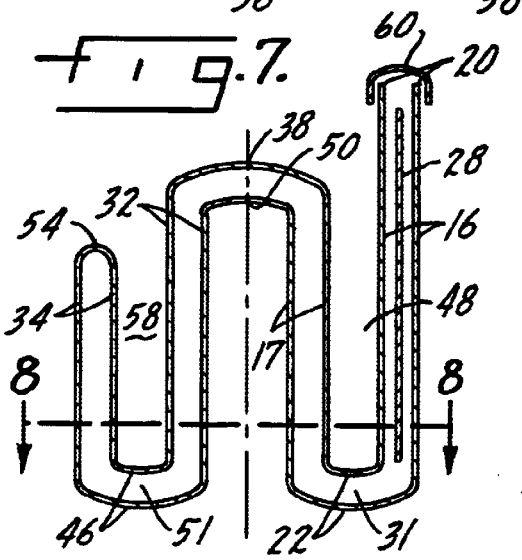
FIG. 7 is a section taken along line 7—7 of FIG. 4 with an exaggerated expansion of the pouch to illustrate its various layers.

As shown in FIGS. 7 and 8, the underlying stiffening element 28 is inserted between the double layers of the first internal member 16 and is preferably narrower than the width thereof so as to not interfere with the stitching of the tape 60 along the side edges of the internal tool receiving portion 12. If desired however, the width of the stiffening element 28 can be expanded to the seams. Although the underlying stiffening element is shown as incorporated within the first internal member 16, it is contemplated that an underlying stiffening element could be used to strengthen any or all parts of the tool pouch including but not limited to additional tool receiving cavities attached to the tool pouch. A curved or segmented stiffening element may also be used for the bail.

To assemble the tool pouch as shown in the drawings, a piece of material starts at the first internal member top end 20 and continues to the bottom end 22. The surface of the first internal member 16 adjacent the user forms the user contact surface 24. At the bottom end 22, the material is folded along fold line 31 in the direction opposite user contact surface 24 and continues upwards to form the second internal member 17 turning at the second internal member top end 38 to form the U-shaped bail 50. Attachment between the first and second internal members 16, 17 occurs along the side edges 18, 36 and forms the internal tool receiving cavity 48. From the bail 50, the material folds over to form the first external member 32 continuing to the first external member bottom end 46 where the material folds again at fold line 51. From the fold line 51, the material forms the second external member 34 with attachment occurring along the side edges 42, 52 of the first and second external member 32, 34 forming the external tool receiving cavity 58. If a layer of material is used of the same fabric, an additional fold line can be added at the second external member top end 54 and the material simply retraces its shape back to the first internal member top end 20 thus forming a piece of material which has a seamless length with attachment being required between the member side edges and the first internal member top end 20 only. If additional layers of the same fabric is required, then a fold line can be created at first internal member top end 20 and retrace the tool pouch shape to second member top end 54 and so on and so forth until the desired number of layers is attained. It is also possible for each multi-layer of fabric to be an individually cut piece rather than a folded over piece.

The methods of attachment forming the internal and external tool receiving cavities 48, 58 include but are not limited to stitching, glueing, riveting or other like methods. By way of example, but not limitation, stitch lines are shown at 66 along tape 60 in FIGS. 2, 4, and 5. Where the multi-layered thickness is comprised of individual pieces of material, then additional attachment points will be required to connect the layers to each other.

Other constructions are also possible. For instance, it is possible for the tool pouch to be comprised of individual elements which together form the internal tool receiving portion 12 or the external tool receiving portion 14. By way of example, the first and second internal members of the internal tool receiving portion could be comprised of separate pieces of material which are attached to each other along their side edges and separate bottom ends forming the internal tool receiving cavity. The first and second external members may be similarly comprised of separate elements which are attached along their sides edges and bottom ends. The bail may also be a point of attachment between the top ends of the second internal member and the first external member. Among all the members, any combination of single or multi-layer construction, underlying stiffening elements and reinforcing seams is also possible.

To insert the tool pouch 10, the user slides the internal tool receiving portion 12 having first and second internal members 16, 17 into the user pocket until the user meets resistance. As shown in FIG. 1, the internal tool receiving cavity 48 receives tools therein while in the user's pocket. The internal tool receiving portion 12 may be insertable into the user's pocket up to the bail 50 with the bottom end 22 being securely positioned adjacent the pocket bottom. The first internal member top end 20 extends upward from the top of the user's pocket when the tool pouch is positioned therein to provide additional protection to the user's clothing during insertion and extraction of the tools. From the bail 50, the tool pouch extends outside of the user's pocket to define the external tool receiving cavity 58.

The tool pouch provides a protected compartment located inside the user's pocket and an another tool compartment located outside the user's pocket. The pouch protects the user's pocket from excessive wear due to repeated insertion and extraction of tools therefrom. It further protects the user's pocket from dirt, oil or the like which can be frequently deposited on tools. The overall appearance of the tool pouch provides a sleek, professional and organized appearance for the wearer and doubles the tool carrying capacity of the user's pocket. The tool pouch allows for complete removal of all the tools from the user's pocket at once simply by lifting the tool pouch out of the user's pocket.

Whereas the preferred form of the invention has been shown and described herein, it should be realized that there may be many modifications, substitutions and alterations thereto. For instance, it is possible for the internal and external tool receiving cavities to have other adaptations such as loops, holes, hooks, other shaped compartments for receiving different types of tools, measuring devices, spare parts, clipboards, keys, cards and other like objects. Although the tool pouch is shown to be sized to fit into a back pocket of the user's pants, it is realized that the tool pouch may be sized to fit other pockets such as the front right or left pant pockets, side clothing pockets, cargo pant pockets, coat pockets, jacket pockets, shirt pockets or other pockets as needed by the user.

What is claimed is:

1. A tool pouch for carrying tools which is mountable to a user pocket on a user's piece of clothing, comprising:

an internal tool receiving portion having at least two generally planar elements which are attached along sides and bottom ends thereof and being insertable into the user pocket to form an internal tool receiving cavity, and an external tool receiving portion having at least two generally planar elements being attached along sides and bottom ends thereof and being positionable outside of the user pocket to form an external tool receiving cavity, the internal tool receiving portion being attached to the external tool receiving portion along adjacent top ends to form a bail, wherein at least one of the internal and external tool receiving portions is comprised of a material which is folded over upon itself and attached along side edges thereof, each planar element of the corresponding tool receiving portion defining a surface which extends continuously between the sides of the respective internal and external tool receiving portion, wherein at least one of the internal and external tool receiving portions has an internally located stiffening member which extends continuously between the sides of the respective tool receiving portion.

2. The tool pouch of claim 1 wherein the internal tool receiving portion has aligned dimensions with the external tool receiving portion.

3. The tool pouch of claim 1 wherein the internal tool receiving portion has one top end adjacent a user contact surface which extends above the bail.

4. The tool pouch of claim 1 wherein the external tool receiving portion has one top end which is positioned below the bail.

5. The tool pouch of claim 1 wherein at least one of the internal and external tool receiving portions has a belt loop positioned thereon.

6. The tool pouch of claim 1 wherein at least one of the internal and external tool receiving portions has belt slots positioned therein.

7. The tool pouch of claim 1 wherein at least one of the internal and external tool receiving portions is made of a multi-layered fabric.

8. The tool pouch of claim 1 wherein the internal and external tool receiving portions are made of one piece of folded material.

9. The tool pouch of claim 1 wherein at least one of the internal and external tool receiving portions has reinforcing tape.

10. A tool pouch for carrying tools which is mountable to a user pocket on a user's piece of clothing, comprising:

a generally planar first internal member having a user contact surface, side edges, a top end and a bottom end;

a generally planar second internal member having side edges, a top end and a bottom end and being attached to the side edges and bottom end of the first internal member opposite the user contact surface to form an internal tool receiving cavity, the first and second internal members being positionable internally within the user pocket, the user contact surface being positioned closest to the user when the first internal member is positioned within the user pocket;

a generally planar first external member having side edges, a top end and a bottom end and being attached to the second internal member at a bail; and a generally planar second external member having side edges, a top end and a bottom end and being attached to the first external member side edges and bottom end to form an external tool receiving cavity which is positioned outside of the user pocket when the first and second internal members are positioned within the user pocket, each member defining a surface which extends continuously between the sides edges, wherein the first internal member has an internal stiffening element which extends continuously between the side edges of the first internal member.

11. The tool pouch of claim 10 wherein the first internal member side edges and bottom end is aligned with the second internal member side edges and bottom end, and the first external member side edges and bottom end is aligned with the second external member side edges and bottom end.

12. The tool pouch of claim 10 wherein the first internal member top end extends above the user pocket to provide protection to the clothing of the user during insertion and extraction of tools.

13. The tool pouch of claim 10 wherein reinforcing tape is stitched along the attachment between the first and second internal members and along the attachment between the first and second external members.

14. The tool pouch of claim 10 wherein the tool pouch is made of a resilient material.

15. The tool pouch of claim 10 wherein the second internal member and the first external member are made of one piece of folded material.

16. The tool pouch of claim 10 wherein the first and second internal members and first and second external members are all made from one piece of folded material.

17. The tool pouch of claim 10 wherein at least one of the first and second internal members and first and second external members are made of a multi-layered material.

18. The tool pouch of claim 10 wherein a belt loop is attached to the user surface of the first internal member.

19. The tool pouch of claim 10 wherein slots are formed on the user surface of the first internal member for receiving a belt.

* * * * *